US010063018B2

(12) United States Patent
Xing et al.

(10) Patent No.: US 10,063,018 B2
(45) Date of Patent: Aug. 28, 2018

(54) PLUG CONNECTOR ASSEMBLY HAVING A SPACE-SAVING METAL SHELL

(71) Applicant: FOXCONN INTERCONNECT TECHNOLOGY LIMITED, Grand Cayman (KY)

(72) Inventors: Da-Wei Xing, Kunshan (CN); Jun Chen, Kunshan (CN); Jerry Wu, New Taipei, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/790,085

(22) Filed: Oct. 23, 2017

(65) Prior Publication Data

US 2018/0115122 A1 Apr. 26, 2018

(30) Foreign Application Priority Data

Oct. 21, 2016 (CN) ..... 2016 1 0918881

(51) Int. Cl.

| | |
|---|---|
| ***H01R 13/66*** | (2006.01) |
| ***H01R 13/717*** | (2006.01) |
| ***H01R 13/6593*** | (2011.01) |
| ***H01R 13/516*** | (2006.01) |
| ***H01R 13/6581*** | (2011.01) |
| *H01R 107/00* | (2006.01) |
| *H01R 24/60* | (2011.01) |

(52) U.S. Cl.

CPC ..... *H01R 13/7172* (2013.01); *H01R 13/516* (2013.01); *H01R 13/6581* (2013.01); *H01R 13/6593* (2013.01); *H01R 13/6658* (2013.01); *H01R 13/6691* (2013.01); *H01R 24/60* (2013.01); *H01R 2107/00* (2013.01)

(58) Field of Classification Search

CPC ..... H01R 13/6658; H01R 13/6581
USPC ..... 439/607.41–607.52
See application file for complete search history.

(56) References Cited

U.S. PATENT DOCUMENTS

| | | | | |
|---|---|---|---|---|
| 8,303,343 | B2 * | 11/2012 | Nagata | H01R 13/6582 439/607.54 |
| 9,350,126 | B2 * | 5/2016 | Little | H01R 24/60 |
| 9,413,123 | B2 * | 8/2016 | Kao | H01R 24/64 |
| 9,450,337 | B2 * | 9/2016 | Kao | H01R 13/6461 |

(Continued)

FOREIGN PATENT DOCUMENTS

| | | |
|---|---|---|
| CN | 204516964 | 7/2015 |

*Primary Examiner* — Ross Gushi
(74) *Attorney, Agent, or Firm* — Wei Te Chung; Ming Chieh Chang

(57) ABSTRACT

A cable connector assembly includes: a mating unit; a cable; a PCB interconnected between the mating unit and the cable; a metal shell enclosing the PCB, a rear of the mating unit, a front of the cable, the metal shell including an upper shell part and a lower shell part, each of the upper and lower shell parts having a main body and a pair of side walls; an insulative outer shell enclosing the metal shell, the rear of the mating unit, the front of the cable; wherein the pair of side walls of the upper shell part extend downwardly and those of the lower shell part extend upwardly to align with each other along an up-and-down direction; and each of the pair of side walls of the lower shell part includes a flap extending inwardly and upwardly to latch an associated side wall of the upper shell part.

17 Claims, 9 Drawing Sheets

(56) References Cited

U.S. PATENT DOCUMENTS

| | | | | |
|---|---|---|---|---|
| 9,450,341 | B2 * | 9/2016 | Kao | H01R 13/6585 |
| 9,472,905 | B2 * | 10/2016 | Peng | H01R 13/6658 |
| 9,478,878 | B2 * | 10/2016 | Wu | H01R 9/0515 |
| 9,478,923 | B2 * | 10/2016 | Kao | H01R 24/60 |
| 9,525,223 | B2 * | 12/2016 | Little | H01R 13/6658 |
| 9,531,144 | B2 * | 12/2016 | Tsai | H01R 13/658 |
| 9,583,889 | B2 * | 2/2017 | Wu | H01R 13/6593 |
| 9,595,796 | B2 * | 3/2017 | Yen | H01R 13/6581 |
| 9,620,909 | B2 * | 4/2017 | Kao | H01R 13/6585 |
| 9,692,187 | B2 * | 6/2017 | Qian | H01R 13/665 |
| 9,748,687 | B2 * | 8/2017 | Yokoyama | H01R 13/502 |
| 9,762,009 | B2 * | 9/2017 | Little | H01R 24/60 |
| 9,774,111 | B2 * | 9/2017 | Liang | H01R 12/57 |
| 9,780,500 | B2 * | 10/2017 | Kao | H01R 13/6658 |
| 9,819,128 | B2 * | 11/2017 | Zhou | H01R 13/7175 |
| 9,843,143 | B2 * | 12/2017 | Wu | H01R 13/72 |
| 9,929,502 | B2 * | 3/2018 | Zhang | H01R 13/6273 |
| 2013/0210273 | A1 * | 8/2013 | Wu | H01R 13/652 439/607.34 |
| 2015/0031246 | A1 | 1/2015 | Wu et al. | |
| 2015/0333451 | A1 * | 11/2015 | Kao | H01R 24/60 439/607.01 |
| 2016/0172795 | A1 | 6/2016 | Zhou et al. | |
| 2016/0204562 | A1 * | 7/2016 | Chen | H01R 43/16 29/428 |
| 2016/0226199 | A1 | 8/2016 | Zhou et al. | |
| 2017/0054256 | A1 * | 2/2017 | Yokoyama | H01R 13/648 |
| 2017/0093091 | A1 * | 3/2017 | Cheng | H01R 4/023 |
| 2017/0207580 | A1 * | 7/2017 | Wu | H01R 4/023 |
| 2018/0001407 | A1 * | 1/2018 | Wu | B23K 1/0016 |

* cited by examiner

PLUG CONNECTOR ASSEMBLY HAVING A SPACE-SAVING METAL SHELL

BACKGROUND OF THE INVENTION

1. Field of the Invention

The present invention relates to a cable connector assembly having a metal shell that includes an upper shell part and a lower shell part latched to each other and both having a respective pair of side walls aligned with each other along an up-and-down direction.

2. Description of Related Arts

U.S. Patent Application Publication No. 2016/0172795, published on Jun. 16, 2016, shows latching of an upper shell part to a lower shell part. Specifically, each of the upper and lower shell parts has a main body and a pair of side walls. The side walls of the upper shell part overlap sidewardly the side walls of the lower shell part.

SUMMARY OF THE INVENTION

A cable connector assembly comprises: a mating unit; a cable; a printed circuit board (PCB) interconnected between the mating unit and the cable; a metal shell enclosing the PCB, a rear of the mating unit, and a front of the cable, the metal shell including an upper shell part and a lower shell part, each of the upper and lower shell parts having a main body and a pair of side walls; and an insulative outer shell enclosing the metal shell, the rear of the mating unit, and the front of the cable; wherein the pair of side walls of the upper shell part extend downwardly and the pair of side walls of the lower shell part extend upwardly to align with each other along an up-and-down direction; and each of the pair of side walls of the lower shell part includes a flap extending inwardly and upwardly to latch an associated side wall of the upper shell part.

DETAILED DESCRIPTION OF THE PREFERRED EMBODIMENT

Figure 1:
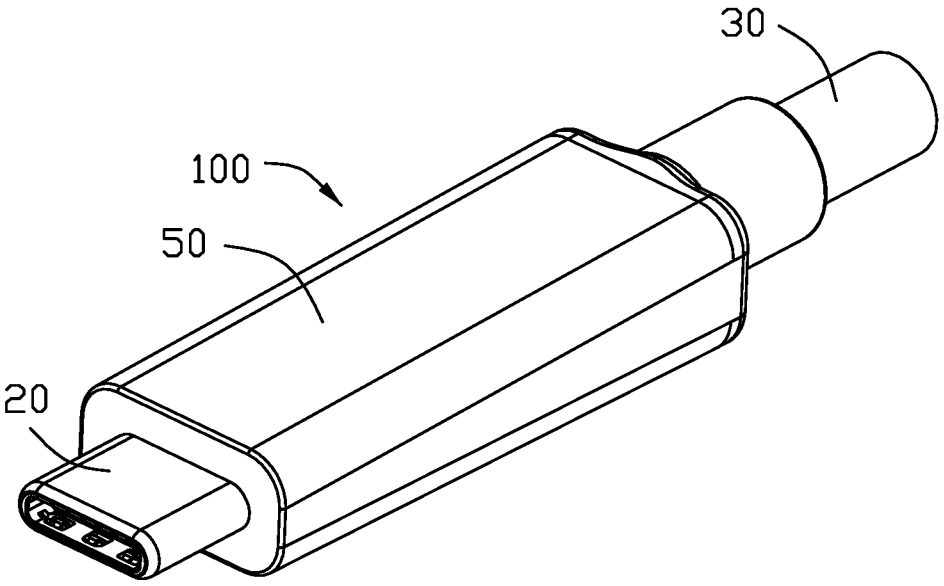
FIG. 1 is a perspective view of a cable connector assembly in accordance with the present invention.

Referring to FIGS. 1-5, a plug connector assembly 100 adapted to plug into a receptacle in two orientations comprises a mating member 20, an internal printed circuit board (PCB) 10 defining opposite surfaces (not labeled) in the vertical direction and opposite front and rear regions in the front-to-back direction perpendicular to the vertical direction, the PCB electrically connected with the mating unit 20, a cable 30 electrically connected with the PCB 10, a metal shell 40 enclosing the PCB 10, a rear of the mating unit 20, and a front of the cable 30, and an insulative outer shell or jacket 50 enclosing the metal shell 40, the rear of the mating unit 20, and the front of the cable 30.

Referring to FIGS. 2-7, the metal shell 40 includes an upper/first shell part 41 and a lower/second shell part 42. The upper shell part 41 has a main body 410 and a pair of (first) side walls 411. Each side wall 411 has a pair of (engaging) spring fingers 412 spaced from each other and bent inwardly. The spring finger 412 is inclined. The lower shell part 42 has a main body 420 and a pair of side walls 421. Each of the pair of (second) side walls 421 of the lower shell part 42 has a pair of flaps 422 extending inwardly and upwardly to latch corresponding side walls 411 of the upper shell part 41. Each flap 422 has a (locking) hole 423. The side wall 411 of the upper shell part 41 has a planar bottom edge 413. The portion of the side wall 421 of the lower shell part 42 between the pair of flaps 422 has a planar top edge 424. The flap 422 has an inclined face 425 which is substantially in line with the planar top edge 424. When the upper shell part 41 and the lower shell part 42 are latched together, the spring fingers 412 of the side wall 411 latch in the holes 423, and the planar bottom edge 413 of the side wall 411 is aligned with the planar top edge 424 of the side wall 421 and the inclined faces 425 and respective top ends of the flaps 422 abut an inner wall surface of the upper shell part 41.

Figure 3:
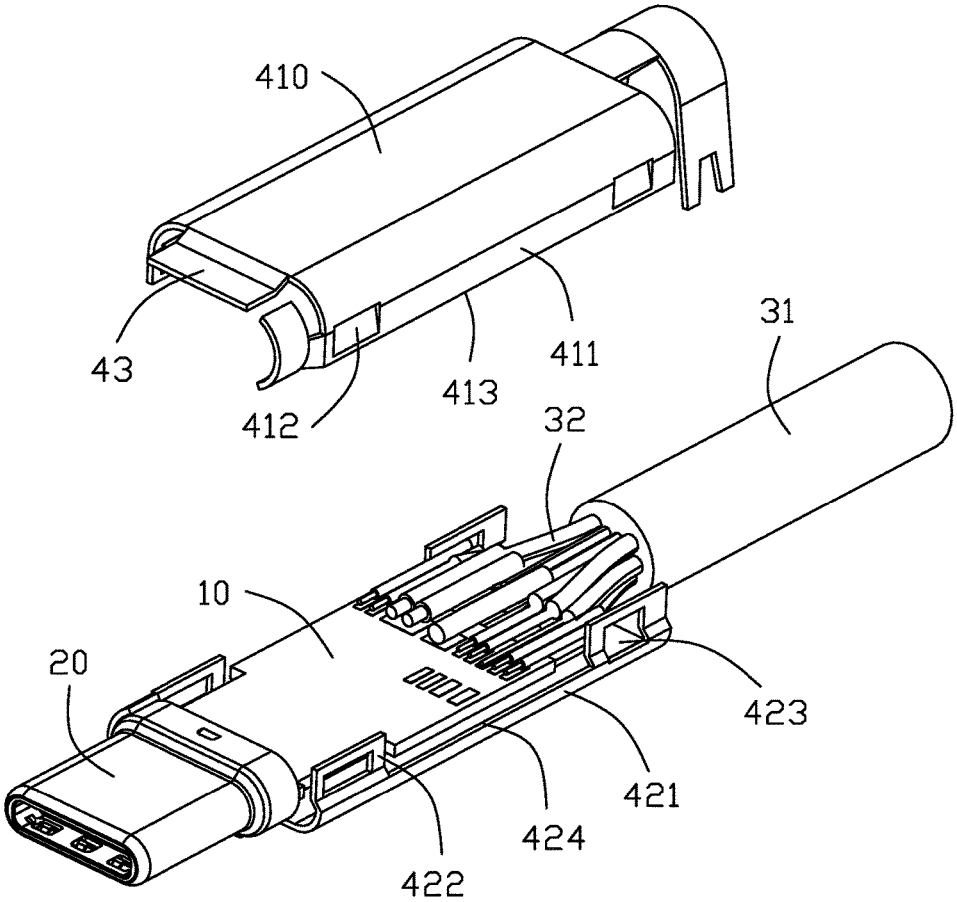
FIG. 3 is a further exploded view of the cable connector assembly in FIG. 2 omitting an insulative outer shell thereof.
Figure 4:
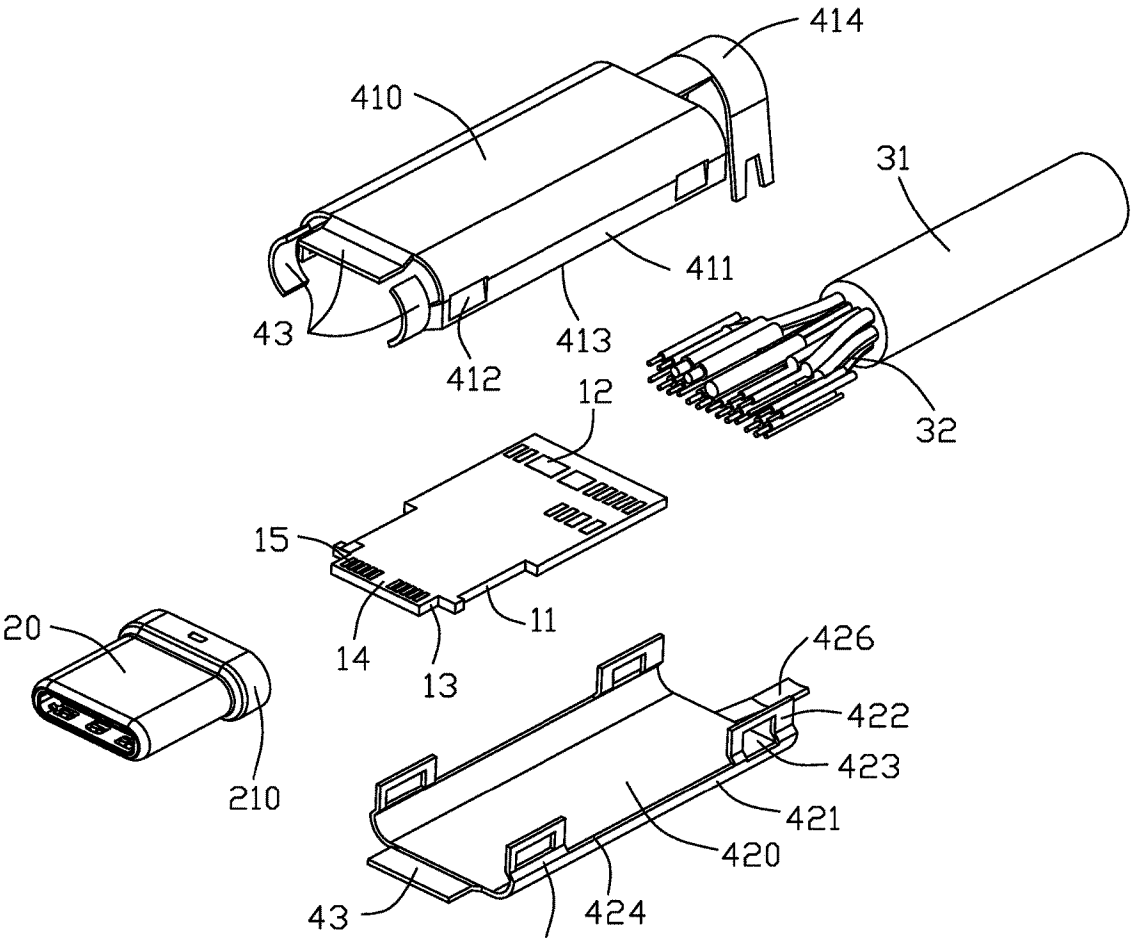
FIG. 4 is a still further exploded view of the cable connector assembly in FIG. 3.
Figure 5:
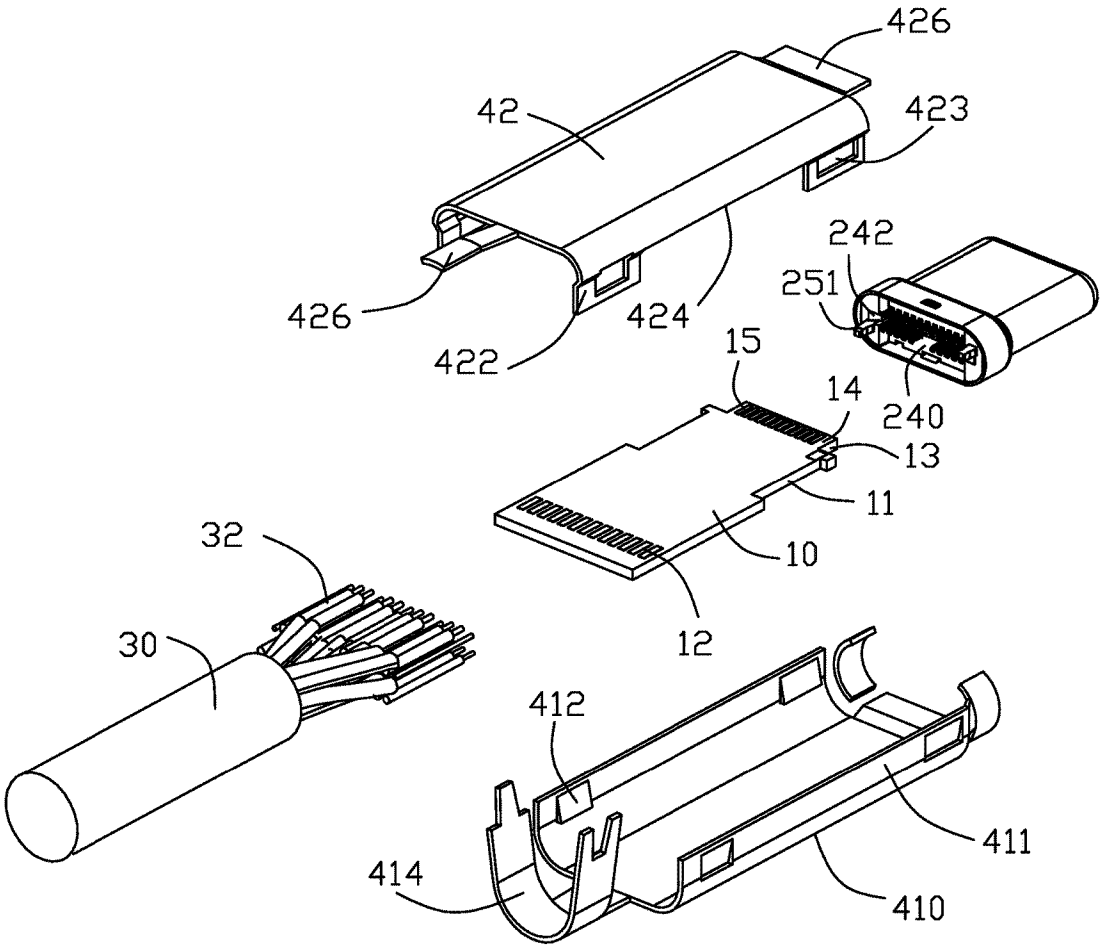
FIG. 5 is a view similar to FIG. 4 but from a different perspective.
Figure 6:
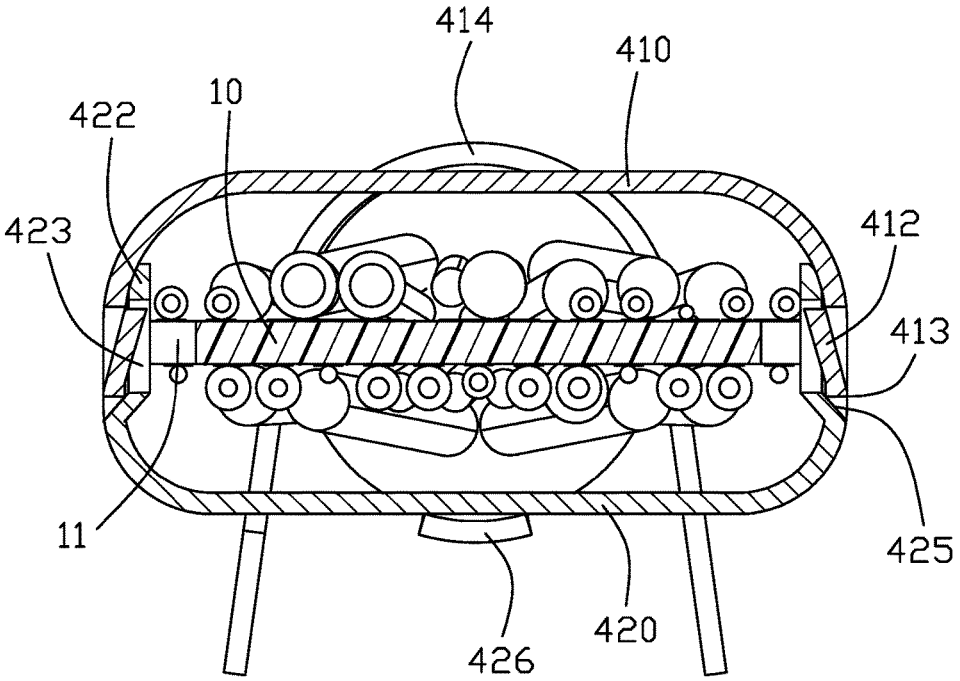
FIG. 6 is a cross-sectional view of the cable connector assembly in FIG. 2 taken along line A-A.

The PCB 10 has a pair of notches 11 at two lateral side portions thereof in a transverse direction perpendicular to both the vertical direction and the front-to-back direction, corresponding to the flaps 422. The notch 11 provides clearance for the flap 422 that is bent inwardly. In this embodiment, as seen in FIG. 3, the flap 422 proximal to the rear of the PCB 10 is located further rearwardly outside of the PCB 10 so that notch is not required. This design achieves firm latching of the upper and lower shell parts 41 and 42 while not increasing an overall width of the metal shell 40. The PCB 10 has plural conductive pads 12 on both surfaces for soldering cable wires 32. The PCB 10 further has a pair of recesses 13 so as to form a narrowed front 14. Plural conductive pads 15 are also provided on the narrowed front 14 of the PCB 10.

The upper shell part 41 further includes a fastener 414 and plural grips 43; the lower shell part 42 further includes a fastener 426 and a grip 43. The cable 30 has a jacket 31 and plural wires 32 connected to the conductive pads 12. The fasteners 414 and 426 are fastened to the jacket 31.

Figure 2:
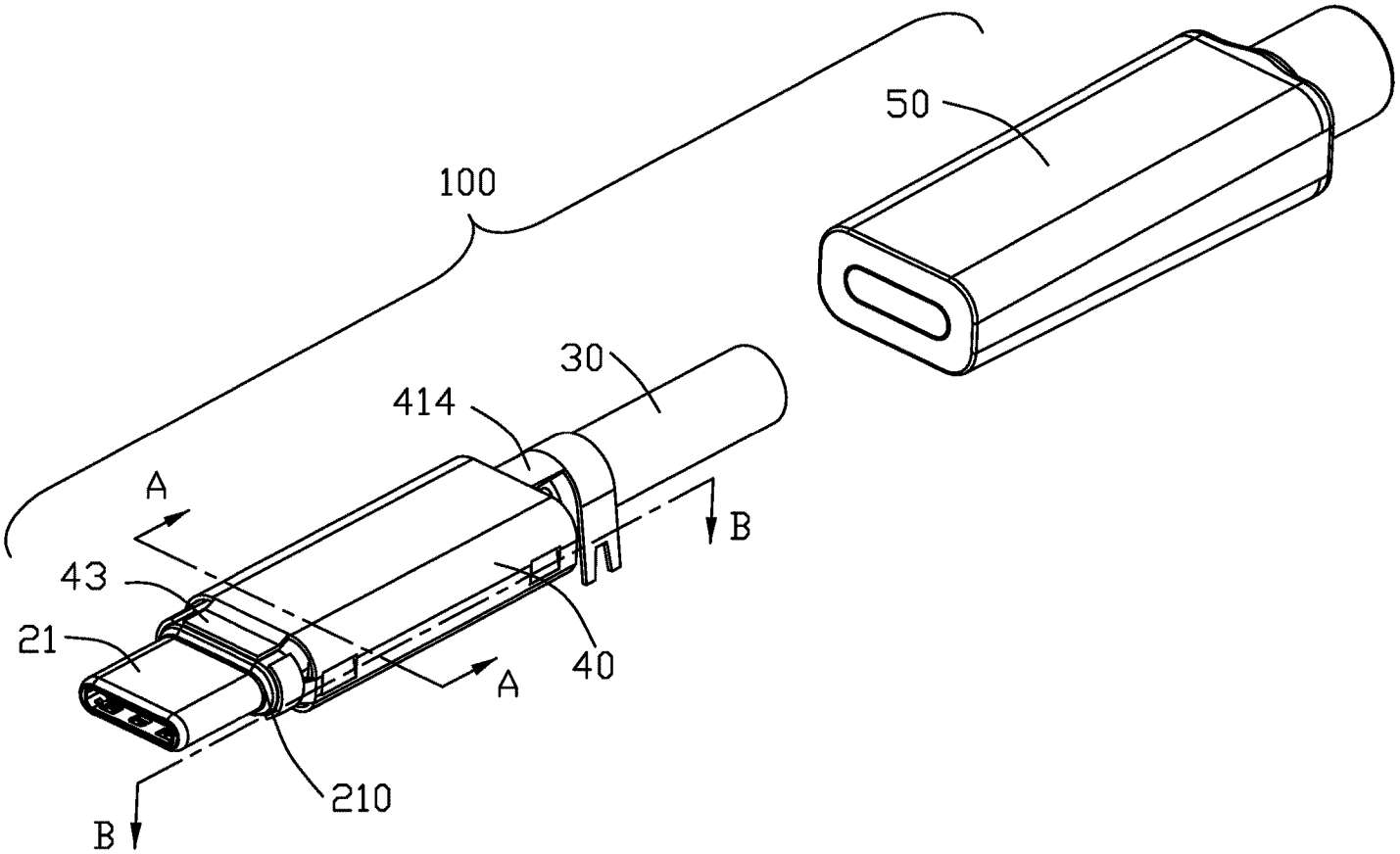
FIG. 2 is a partly exploded view of the cable connector assembly.
Figure 7:
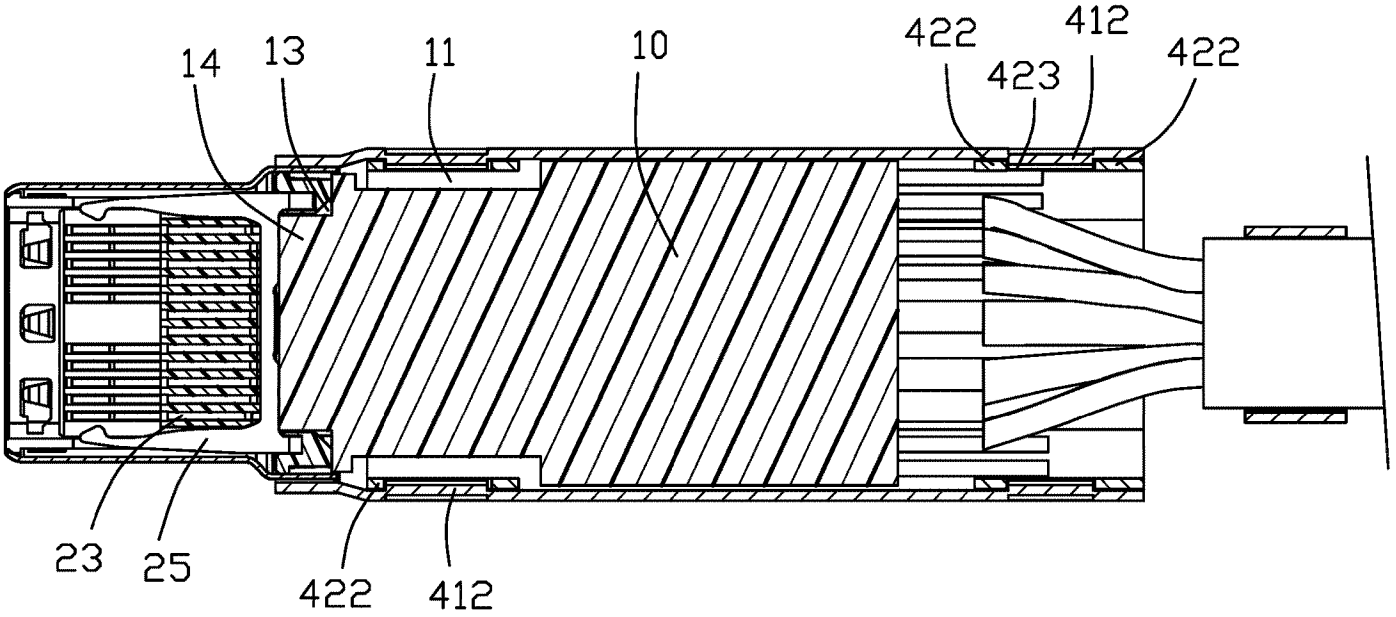
FIG. 7 is a cross-sectional view of the plug connector assembly in FIG. 2 taken along line B-B.
Figure 8:
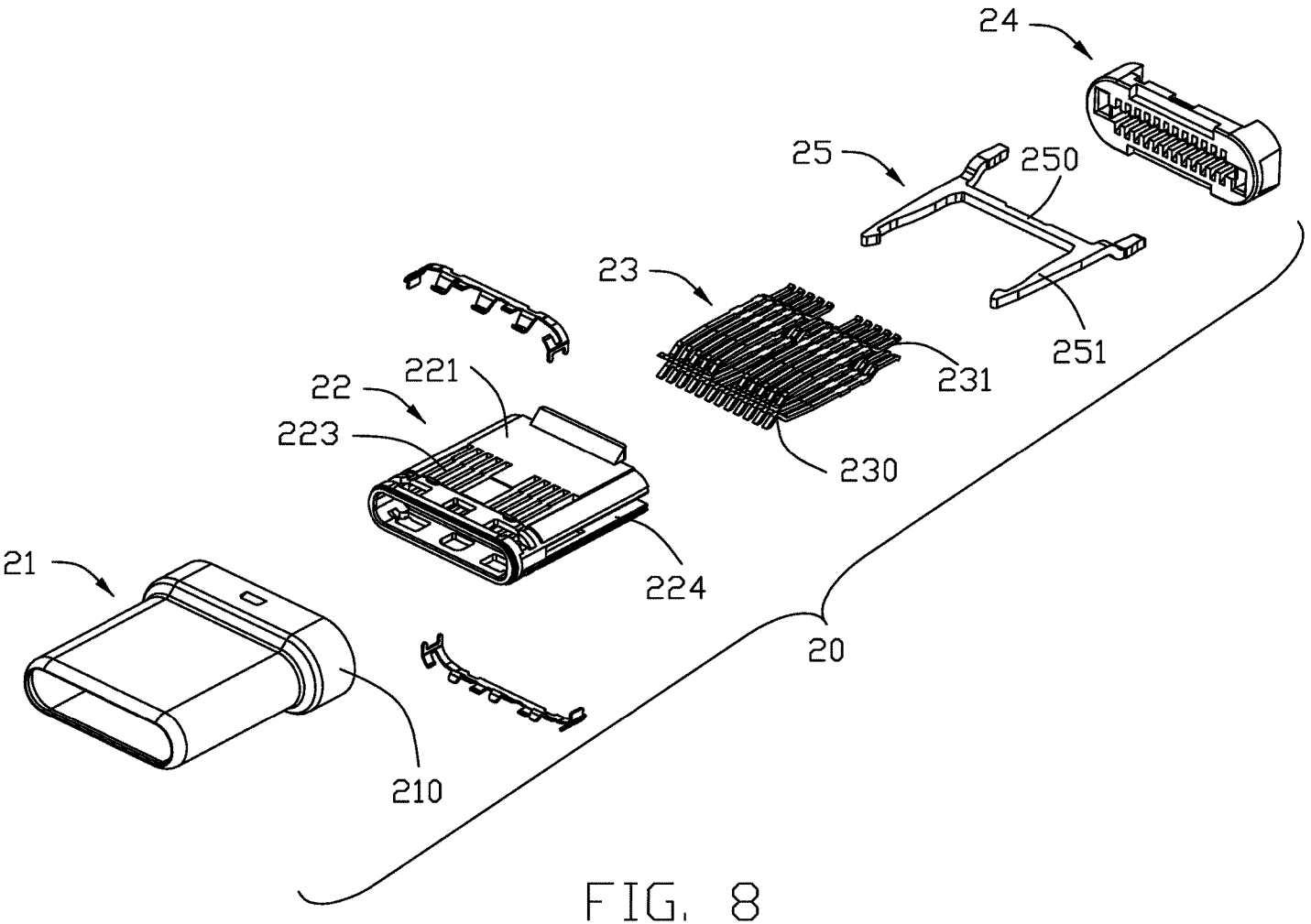
FIG. 8 is an exploded view of a mating unit of the cable connector assembly.
Figure 9:
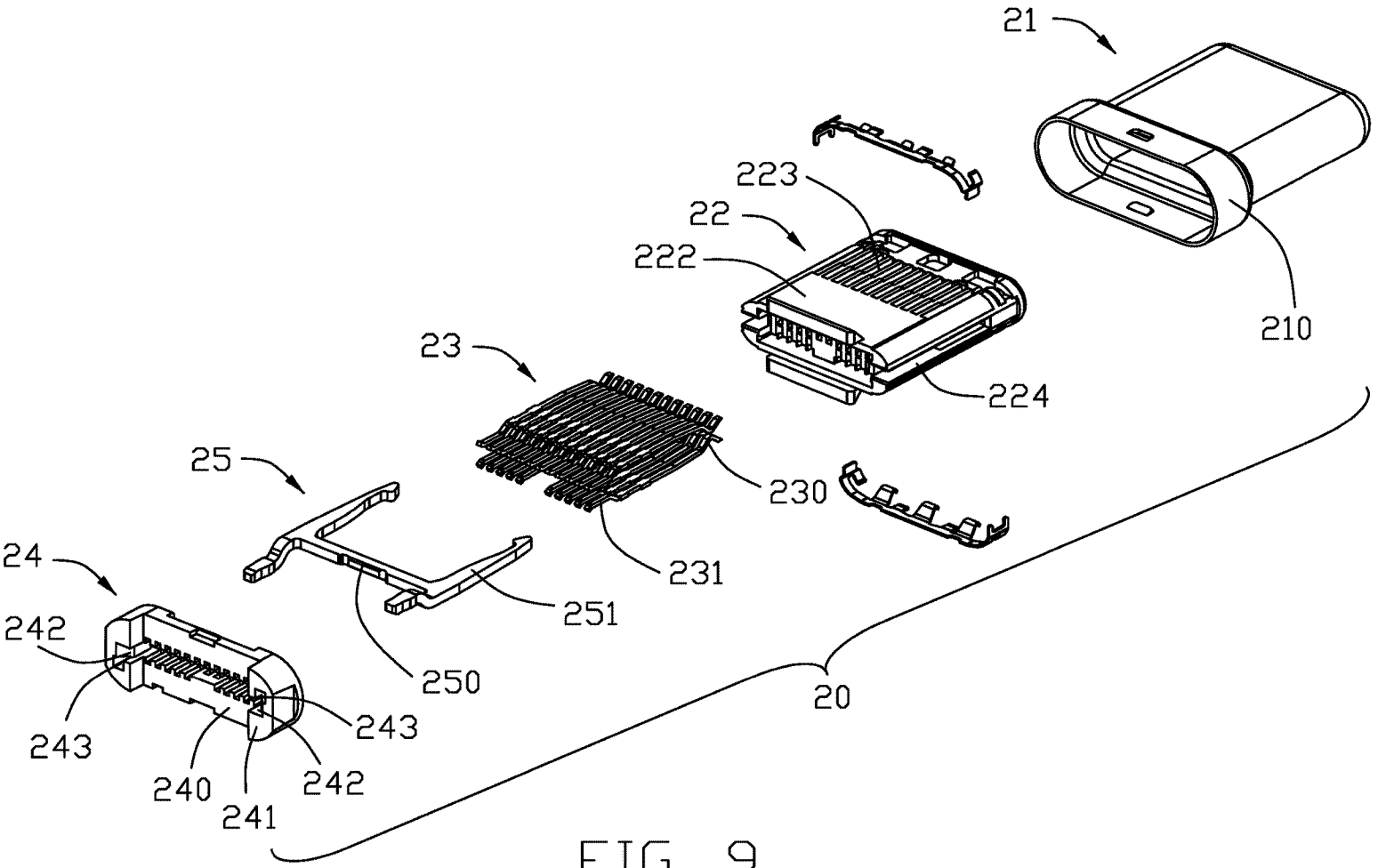
FIG. 9 is a view similar to FIG. 8 but from a different perspective.

As shown in FIGS. 7-9, the mating unit 20 includes a metallic shell 21, an insulative body 22, plural contacts 23 received in the insulative body, a base 24 formed with the contacts, and a clip 25. The metallic shell 21 has a widened portion 210. The grips of the shell 4 enclose the widened portion 210, as seen in FIG. 2. Upper surface 221 and lower surface 222 of the insulative body 22 have respective grooves 223. Each of the contacts 23 has a contacting portion 230 extending into the groove 223 and a soldering tail 231. The conductive pads 15 on the narrowed front 14 of the PCB 10 electrically connect with the soldering tails 231. The clip has a beam 250 and a pair of arms 251. The insulative body 22 has a pair of slots 224 for receiving the pair of arms 251. The base 24 further includes a pair of posts 241 each having a first groove 242 and a second groove 243.

The arm 251 extends through the second groove 243. The narrowed front 14 of the PCB 10 is received between the first grooves 242.

As shown in FIGS. 1 and 2, the insulative outer shell 50 encloses the metal shell 40, encloses the widened portion 210 of the mating unit 20, and encloses part of the jacket 31 wrapped by the fasteners 414 and 426. One feature of the invention is to have the securing means, i.e., a combination of the flap 422 and the spring finger 412, located within the notch 11 so as to narrow the width of the metal shell 40, on which an insulative jacket is applied, for efficiently reducing the width of the whole corresponding connector assembly. Understandably, in some side by side arranged dual-port receptacle connector assembly with a limited space between the dual ports, the width-narrower plug may be welcome, compared with the traditional one which precludes the densely arranged mating ports along the transverse direction.

What is claimed is:

1. A cable connector assembly comprising:

a mating unit;

a cable;

a printed circuit board (PCB) interconnected between the mating unit and the cable;

a metal shell enclosing the PCB, a rear of the mating unit, and a front of the cable, the metal shell including an upper shell part and a lower shell part, each of the upper and lower shell parts having a main body and a pair of side walls; and an insulative outer shell enclosing the metal shell, the rear of the mating unit, and the front of the cable; wherein the pair of side walls of the upper shell part extend downwardly and the pair of side walls of the lower shell part extend upwardly to align with each other along an up-and-down direction; and each of the pair of side walls of the lower shell part includes a flap extending inwardly and upwardly to latch an associated side wall of the upper shell part.

2. The cable connector assembly as claimed in claim 1, wherein the flap has a hole and the side wall of the upper shell part has a spring finger latched to the hole.

3. The cable connector assembly as claimed in claim 1, wherein the PCB has a notch accommodating the flap.

4. A cable connector assembly comprising:

a printed circuit board defining opposite first and second surfaces in a vertical direction, and opposite front and rear regions along a front-to-back direction perpendicular to the vertical direction, and a pair of notches in two opposite lateral sides in a transverse direction perpendicular to both said vertical direction and said front-to-back direction a mating unit mounted upon the front region;

a cable mounted upon the rear region; and a metal shell enclosing the printed circuit board, a rear section of the mating unit and a front section of the cable, said metal shell including opposite first and second shell parts assembled to each other in the vertical direction, said metal shell further including means for securing the first shell part and the second shell part together in the vertical direction; wherein said means is located within the corresponding notch.

5. The cable connector assembly as claimed in claim 4, wherein the first shell part includes a first side wall and the second shell part includes a second side wall aligned with the first side wall in the vertical direction.

6. The cable connector assembly as claimed in claim 5, wherein an edge of the first side wall abuts against another edge of the second side wall in the vertical direction.

7. The cable connector assembly as claimed in claim 6, wherein a lateral side edge of the printed circuit board intimately abuts against the corresponding first side wall and second side wall in the transverse direction.

8. The cable connector assembly as claimed in claim 4, wherein said means includes an engaging finger on the first shell part and a flap with a locking hole on the second shell part, said spring finger being engaged within the locking hole.

9. The cable connector assembly as claimed in claim 8, wherein said flap is inwardly offset from a side wall of the second shell part in the transverse direction.

10. The cable connector assembly as claimed in claim 4, further including another means of securing the first shell part and the second shell part together in the vertical direction, wherein said another means is located behind the printed circuit board in the front-to-back direction.

11. A cable connector assembly comprising:

a printed circuit board defining opposite first and second surfaces in a vertical direction, and opposite front and rear regions along a front-to-back direction perpendicular to the vertical direction;

a mating unit mounted upon the front region;

a cable mounted upon the rear region; and a metal shell enclosing the printed circuit board, a rear section of the mating unit and a front section of the cable, said metal shell including opposite first and second shell parts assembled to each other in the vertical direction, said metal shell further including means for securing the first shell part and the second shell part together in the vertical direction; wherein the first shell part includes a first side wall in a transverse direction perpendicular to both said vertical direction and the front-to-back direction, and the second shell part includes along the transverse direction a second side wall aligned with the first side wall in the vertical direction while said means is intimately located inside said aligned first side wall and second side wall in the transverse direction.

12. The cable connector assembly as claimed in claim 11, wherein an edge of the first side wall abuts against another edge of the second side wall in the vertical direction.

13. The cable connector assembly as claimed in claim 11, wherein a lateral side edge of the printed circuit board intimately abuts against the corresponding first side wall and second side wall in the transverse direction.

14. The cable connector assembly as claimed in claim 11, wherein said means includes an engaging finger on the first shell part and a flap with a locking hole on the second shell part, said spring finger being engaged within the locking hole.

15. The cable connector assembly as claimed in claim 11, wherein said flap is inwardly offset from the corresponding side wall of the second shell part in the transverse direction.

16. The cable connector assembly as claimed in claim 11, further including another means of securing the first shell part and the second shell part together in the vertical direction, wherein said another means is located behind the printed circuit board in the front-to-back direction.

17. The cable connector assembly as claimed in claim 11, wherein the printed circuit board defines a pair of notches in opposite lateral side edges to receive said means.

* * * * *